US007773061B2

(12) United States Patent
Cok et al.

(10) Patent No.: US 7,773,061 B2
(45) Date of Patent: Aug. 10, 2010

(54) METHOD AND APPARATUS FOR UNIFORMITY COMPENSATION IN AN OLED DISPLAY

(75) Inventors: Ronald S. Cok, Rochester, NY (US); Christopher J. White, Avon, NY (US)

(73) Assignee: Global OLED Technology LLC, Wilmington, DE (US)

( * ) Notice: Subject to any disclaimer, the term of this patent is extended or adjusted under 35 U.S.C. 154(b) by 950 days.

(21) Appl. No.: 11/556,323

(22) Filed: Nov. 3, 2006

(65) Prior Publication Data

US 2008/0122761 A1 May 29, 2008

(51) Int. Cl.
*G09G 3/30* (2006.01)

(52) U.S. Cl. ..... 345/77; 345/76; 345/82; 345/83

(58) Field of Classification Search ..... 345/76, 345/77, 82, 83
See application file for complete search history.

(56) References Cited

U.S. PATENT DOCUMENTS

| | | | | |
|---|---|---|---|---|
| 4,769,292 | A | 9/1988 | Tang et al. | |
| 5,061,569 | A | 10/1991 | Van Slyke et al. | |
| 6,081,073 | A | 6/2000 | Salam | |
| 6,473,065 | B1 | 10/2002 | Fan | |
| 6,911,961 | B2 * | 6/2005 | Miller et al. | 345/82 |
| 2005/0206636 | A1 * | 9/2005 | Kanai | 345/204 |
| 2005/0280615 | A1 | 12/2005 | Cok et al. | |
| 2006/0092183 | A1 * | 5/2006 | Malmberg | 345/690 |
| 2006/0221326 | A1 * | 10/2006 | Cok et al. | 356/121 |
| 2007/0236419 | A1 * | 10/2007 | Wacyk et al. | 345/76 |

FOREIGN PATENT DOCUMENTS

| | | |
|---|---|---|
| EP | 1 424 672 | 6/2004 |
| WO | 2006/105499 | 10/2006 |

OTHER PUBLICATIONS

Phillip I. Good et al., Common Errors in Statistics (and How to Avoid Them), 2006, Alternate Methods of Regression, Chapter 11, pp. 163-173.

* cited by examiner

*Primary Examiner*—Amare Mengistu
*Assistant Examiner*—Robert R Rainey
(74) *Attorney, Agent, or Firm*—Morgan Lewis & Bockius LLP

(57) ABSTRACT

A method of compensating uniformity of an OLED device, having a plurality of light-emitting elements, including providing the OLED display; and measuring the performance of one or more light-emitting elements at three or more different code values. At least two different groups of code values are formed from the three or more code values, while calculating a linear transformation for converting an input signal to a compensated signal from the performance measurements for each of the groups. Subsequently, the difference between the measured performance and compensated signal is calculated over the range of code values for each of the groups; while the linear transformation, having a preferred difference, is selected. Additionally an input signal is received and employed with the selected linear transformation to calculate a compensated signal to drive the OLED display.

15 Claims, 6 Drawing Sheets

METHOD AND APPARATUS FOR UNIFORMITY COMPENSATION IN AN OLED DISPLAY

FIELD OF THE INVENTION

The present invention relates to OLED displays having a plurality of light-emitting elements and, more particularly, to compensating for non-uniformity of the light-emitting elements in the display.

BACKGROUND OF THE INVENTION

Organic Light Emitting Diodes (OLEDs) have been known for some years and have been recently used in commercial display devices. Such devices employ both active-matrix and passive-matrix control schemes and can employ a plurality of light-emitting elements. The light-emitting elements are typically arranged in two-dimensional arrays with a row and a column address for each light-emitting element, and are driven by a data value associated with each light-emitting element to emit light at a brightness corresponding to the associated data value. However, such displays suffer from a variety of defects that limit the quality of the displays. In particular, OLED displays suffer from non-uniformities in the light-emitting elements. These non-uniformities can be attributed to both the light emitting materials in the display and, for active-matrix displays, to variability in the thin-film transistors used to drive the light emitting elements.

It is known in the prior art to measure the performance of each pixel in a display and then to correct for the performance of the pixel to provide a more uniform output across the display. U.S. Pat. No. 6,081,073 entitled, "Matrix Display with Matched Solid-State Pixels" by Salam, issued Jun. 27, 2000, describes a display matrix with a process and control means for reducing brightness variations in the pixels. This patent describes the use of a linear scaling method for each pixel based on a ratio between the brightness of the weakest pixel in the display and the brightness of each pixel. However, this approach will lead to an overall reduction in the dynamic range and brightness of the display, and a reduction and variation in the bit depth at which the pixels can be operated.

U.S. Pat. No. 6,473,065, entitled "Methods Of Improving Display Uniformity Of Organic Light Emitting Displays By Calibrating Individual Pixel" by Fan, issued Oct. 29, 2002, describes methods of improving the display uniformity of an OLED. In order to improve the display uniformity of an OLED, the display characteristics of all organic-light-emitting-elements are measured, and calibration parameters for each organic-light-emitting-element are obtained from the measured display characteristics of the corresponding organic-light-emitting-element. The calibration parameters of each organic-light-emitting-element are stored in a calibration memory. The technique uses a combination of look-up tables and calculation circuitry to implement uniformity correction. However, the described approaches require either a lookup table providing a complete characterization for each pixel, or extensive computational circuitry within a device controller. This is likely to be expensive and impractical in most applications. In particular, the memory required to store compensation information can be costly. Hence, it is useful to minimize this cost.

One simple technique for compensating AM-OLED displays may be to measure the output of all of the pixels at two pre-determined code values corresponding to presumed luminance output levels. The output can be used to determine a common gain and offset for all of the pixels. However, this technique provides only a global adjustment for the pixels and does not address differences between the pixels. A more complex method is to measure the output of each of the pixels at the same, common pre-determined levels. The output measured for each pixel can be used to provide a custom offset and gain forming a linear approximation of the response of each pixel. However, this second technique may not provide the optimum custom offset and gain, since the response of the pixels may not be linear and a linear approximation will, therefore, create errors at various light levels.

One technique that can minimize the error is to employ a complete look-up table providing a correction for every code value of each pixel. However, such a solution requires a large, expensive memory. Alternatively, a correction curve may be estimated by employing a series of linear correction values defining a series of line segments. Such an approach reduces the memory storage somewhat, and may provide approximate corrections, but the memory requirements are still large and complex control circuitry may be required to select the appropriate line segment, increasing costs.

There is a need, therefore, for an improved method of providing uniformity in an OLED display that overcomes these objections.

SUMMARY OF THE INVENTION

In accordance with one embodiment, the invention is directed towards a method of compensating uniformity of an OLED device that has a plurality of light-emitting elements, including the steps of:

a) providing an OLED display having one or more light-emitting elements, each light-emitting element comprising a first electrode and a second electrode and at least one light-emitting layer formed between the electrodes responsive to a current passing through the electrodes and an electronic circuit responsive to an external controller causing a current to pass through the electrodes and the light-emitting layer to emit light;

b) measuring the performance of the one or more light-emitting elements at three or more different code values;

c) forming at least two different groups of code values from the three or more code values, calculating a linear transformation converting an input signal to a compensated signal from the performance measurements for each of the groups;

d) calculating the difference between the measured performance and compensated signal over the range of code values for each of the groups;

e) selecting the linear transformation having a preferred difference; and f) receiving an input signal and employing the selected linear transformation to calculate a compensated signal to drive the OLED display.

ADVANTAGES

In accordance with various embodiments, the present invention may provide the advantage of improved uniformity in a display that reduces the complexity of calculations, minimizes the amount of data that must be stored, improves the yields of the manufacturing process, and reduces the electronic circuitry needed to implement the uniformity calculations and transformations.

DETAILED DESCRIPTION OF THE INVENTION

Figure 1:
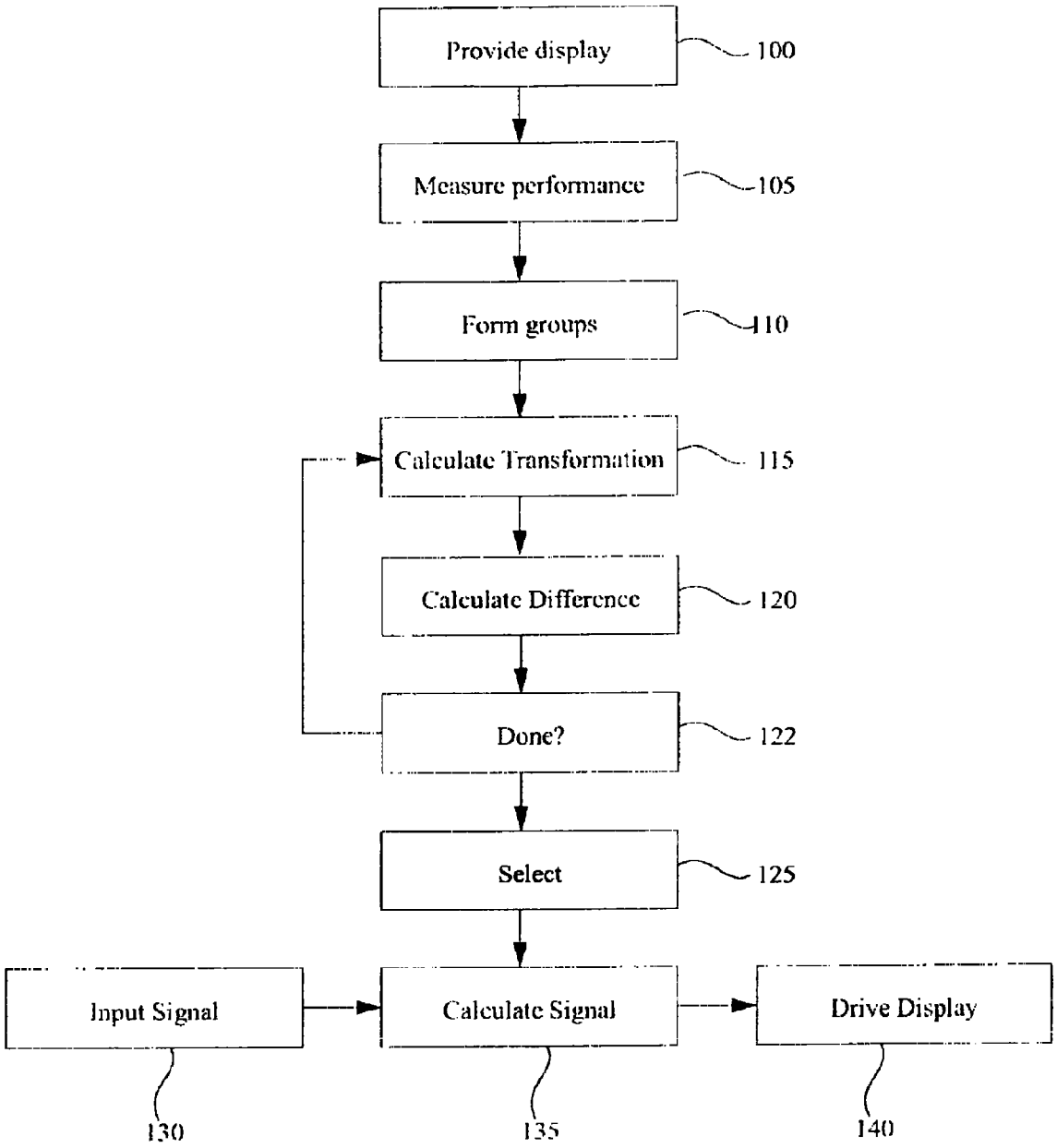
FIG. 1 is a flow diagram illustrating the method of the present invention.

Referring to FIG. 1, the present invention is directed to a method and an apparatus for the compensation uniformity variations in OLED displays, comprising several steps, such as step 100 of providing an OLED display, having one or more light-emitting elements, each light-emitting element comprising a first electrode and a second electrode and at least one light-emitting layer formed between the electrodes responsive to a current passing through the electrodes and an electronic circuit responsive to an external controller causing a current to pass through the electrodes and the light-emitting layer to emit light. Step 105 measures the performance of the one or more of light-emitting elements at three or more different code values. Step 110 forms at least two different groups of code values from the three or more code values, while step 115 calculates a linear transformation for converting an input signal to a compensated signal from the performance measurements for each of the groups. Step 120 calculates the difference between the measured performance and the input signal over the range of code values for each of the groups, until all desired groups are tested in step 122; and step 125 selects the linear transformation having a preferred difference. During step 130, an input signal is received Step 135 employs the selected linear transformation to calculate a compensated signal for driving the OLED display in step 140.

Figure 2:
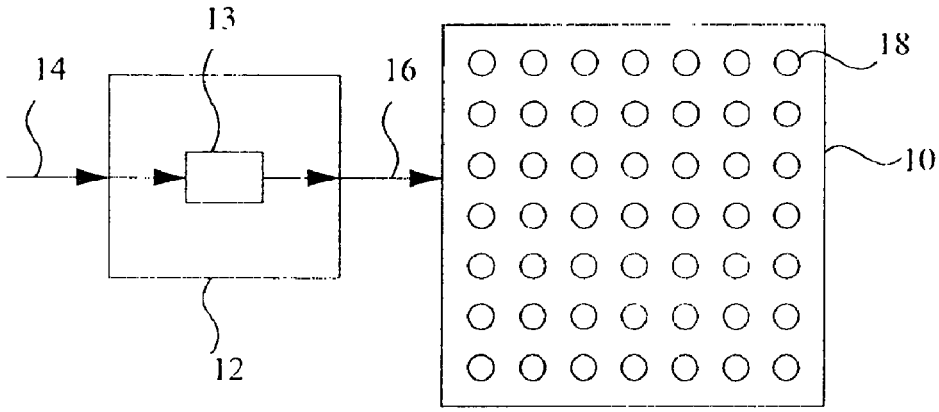
FIG. 2 is a schematic diagram illustrating an embodiment of the present invention.

Referring to FIG. 2, according to the present invention, an OLED display device has a display 10, having one or more light-emitting elements 18, and an external controller 12 for driving the display in response to an input signal 14. Because the OLED display 10 does not have a desired response to the input signal 14, the external controller 12 transforms the input signal 14 to form a compensated signal 16, using circuitry 13, so that the output of the display 10 more closely conforms to a desired response. Such circuitry is known in the art and may comprise, for example, digital memory and logic circuits. OLED displays are also known.

A variety of groups of code values may be selected to form various linear approximations of the light-emitting element performance and corresponding linear transformations. In one embodiment of the present invention, the groups are pairs of code values that define a line. In another embodiment, groups having three or more code values may be employed with a least-squares fit to define the line. Other methods known in the mathematical art to determine a line from a plurality of points may be employed.

Figure 3:
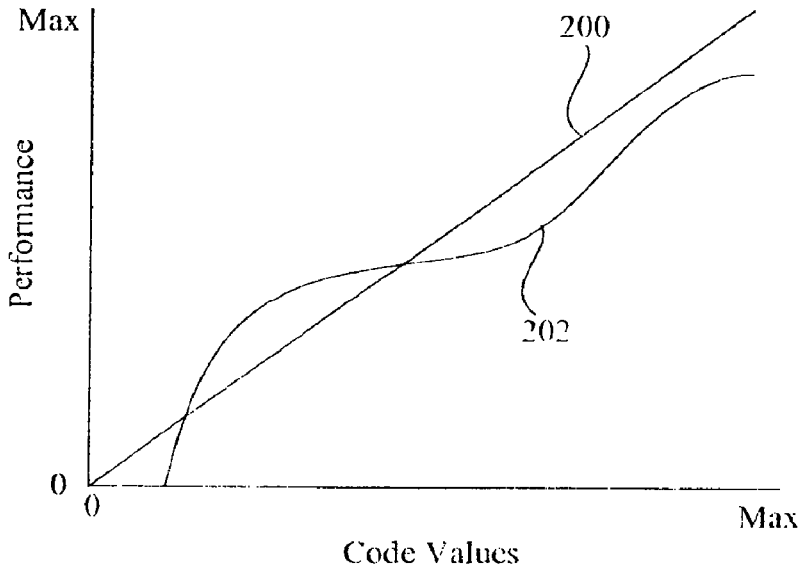
FIG. 3 is a graph illustrating response curves useful in understanding the present invention.

The input signal 14 typically has a range of values, for example, eight bits, defining a digital signal, having code values from 0 to 255. Other ranges and numbers of bits may be employed with the current invention, as well as conventional analog signals. Referring to FIG. 3, an input signal with a desired response is illustrated with curve 200. Note that transformations into and out of one imaging space, for example, logarithmic, into another imaging space, for example, linear, may be employed to provide a desired imaging space for the compensation step, or for driving the display itself. Such transforms are known in the art. In one embodiment, the compensation is performed in a linear imaging space.

Still referring to FIG. 3, a sample curve 202 showing a more realistic response curve of an OLED display is illustrated. Note that, because active-matrix display devices incorporate thin-film circuitry having a non-zero turn-on voltage, a minimum code value greater than zero, applied to a digital-to-analog converter to drive the display may be necessary to emit light. Moreover, the response of the sample curve 202 increases in code values may not provide the desired increase in light output. For example, the response may not be linear and may not have the desired slope. The present invention provides a means to compensate the input signal 14 having a desired response 200 to a compensated signal 16 that will cause an actual response, for example, the sample curve 202, to approximate the desired response. This is done by employing a linear transformation to convert the input signal 14 to a compensated signal 16. A linear transformation is employed, because the storage and computation requirements for computing the transformation are reduced. The linear transformation is found by approximating the actual performance of each light-emitting element 18 in the display 10 with a line characterizing the performance, and employing the characterization to form the linear transformation. However, because the actual performance may not be linear, the response of the display 10 to input signals 14 that are compensated using this simplified representation of actual performance may have some error. According to the present invention, a plurality of actual performance characterizations are employed to form a corresponding plurality of optional linear transformations and the error computed for each of the plurality of options. The linear transformation having the best performance and preferred error (typically the minimum error) is selected to form the compensated signals 18, stored in the controller 12 and transformation circuitry 13, and employed to compensate the input signal 14 to form the compensated signal 16.

Figure 5:
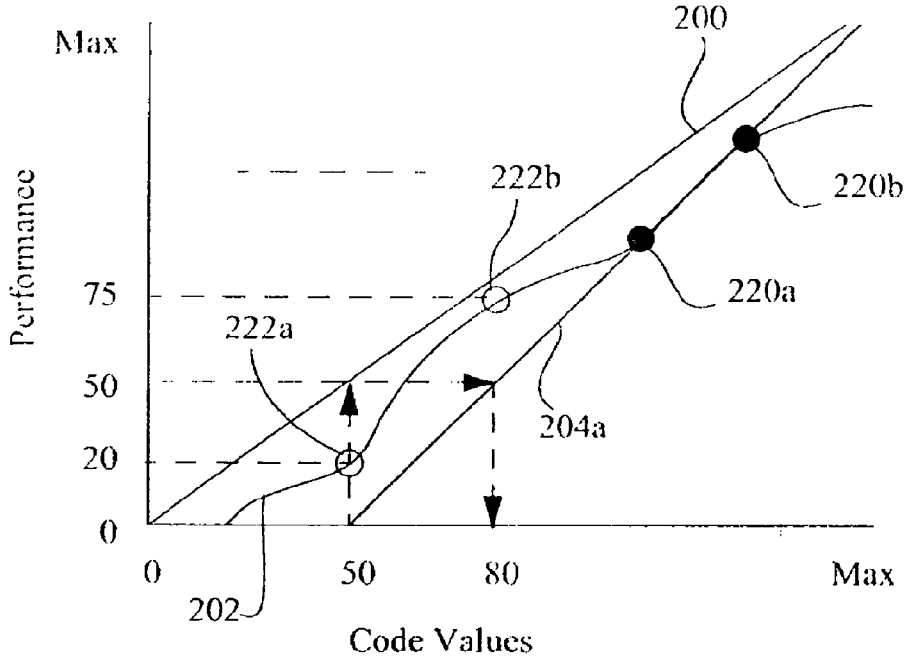
FIG. 5 is a graph illustrating a response curves and a first approximation according to the present invention.
Figure 6:
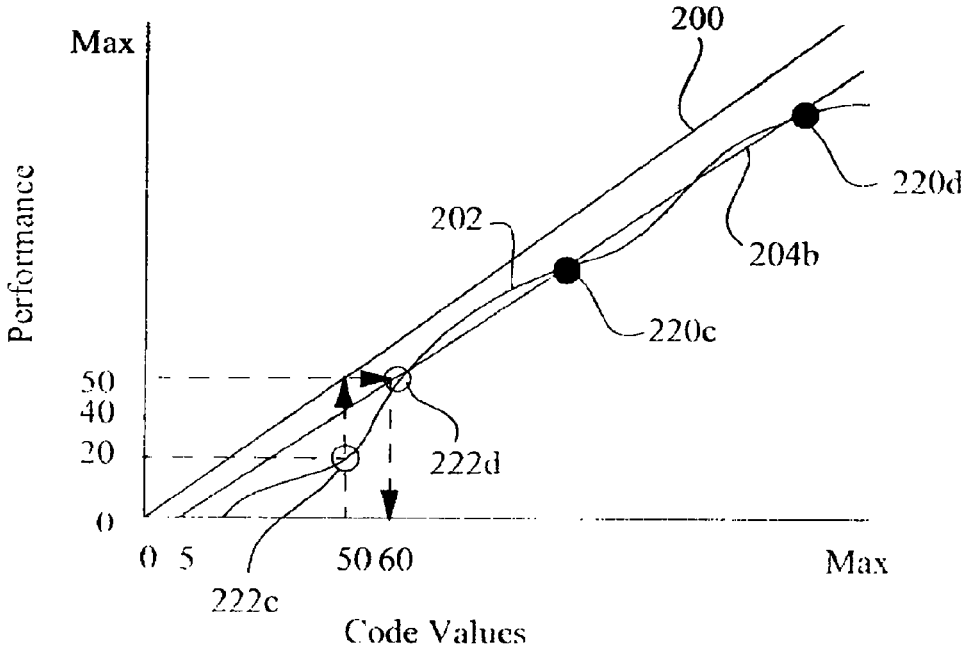
FIG. 6 is a graph illustrating a response curve and a second approximation having a smaller error according to the present invention.

Referring to FIGS. 5 and 6, the simplified representations 204*a*, 204*b*, respectively, are linear functions and may be defined by two values. The first value of the simplified representations 204*a*, 204*b* may be an offset value representing the maximum code value at which the light-emitting element emits less than a minimum amount of light. This point corresponds to the maximum input signal value that has no response, i.e. the point at which the response curve crosses the zero point of the ordinate of a graph plotting the luminance versus the input signal value. The second value of the simplified representations 204*a*, 204*b* may be gain values, representing the slope of a line that represents the ratio between changes in code value and changes in response. However, because the actual performance of a light-emitting element is not linear and the performance may not correspond to any particular offset and gain value, the offset and gain value best matching the individual characteristics of each light-emitting element or group of elements is chosen. This is done by calculating the difference (error) between actual performance over a range of input values (e.g. digital code values), and the compensated signal. By selecting the optimum gain and offset value having the least error, the error is minimized and the performance of each light-emitting elements or group of elements is optimized. Since a very simple representation having only two values is stored, both the memory and the computing requirements are minimized, usefully reducing the cost of the OLED device.

Figure 4:
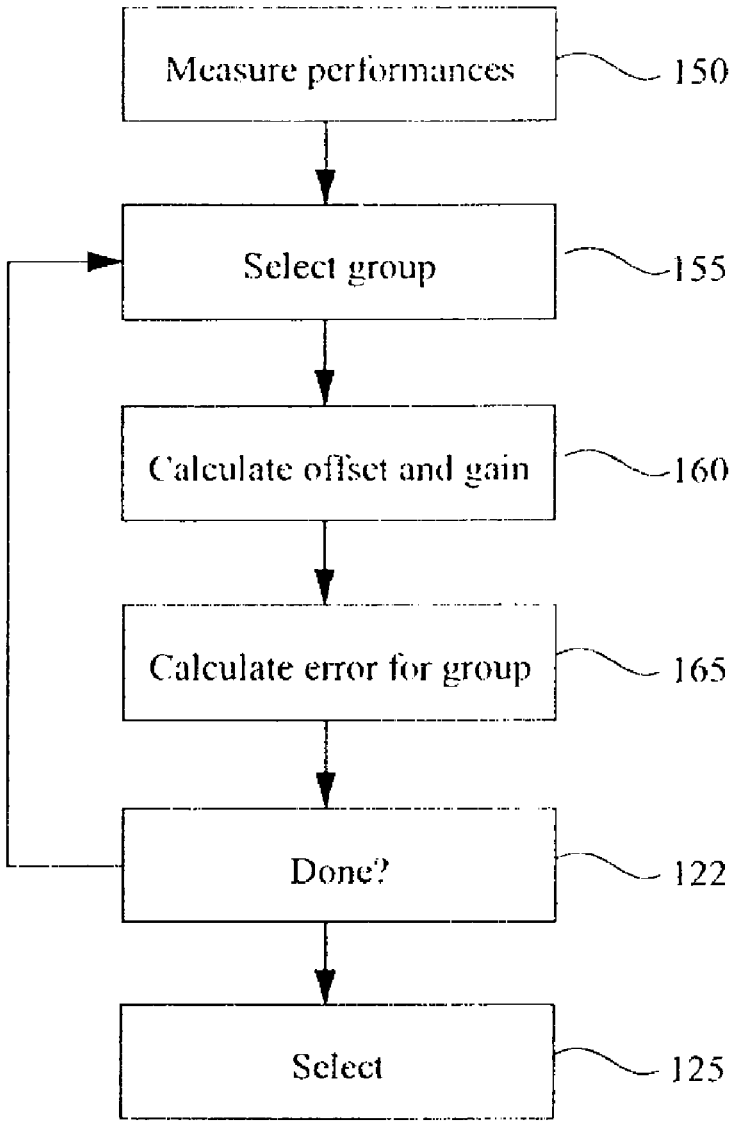
FIG. 4 is a more detailed flow diagram illustrating a portion of the method of the present invention.

Referring to FIG. 4, the measurement and calculation steps are described in more detail. According to this invention, the light output for each light-emitting element (pixel or sub-pixel), or groups of elements, may be measured in step 150 at a plurality of levels. A group of measurements may be selected in step 155 and used in step 160 to calculate a different offset and gain. Each offset and gain pair in step 165 may be used to calculate the error between the representation of the performance and actual performance. The process is repeated in step 122, until the error from a plurality of groups has been determined. The offset and gain pair defining the linear transformation having the lowest overall difference (error) is selected in step 125 and stored in a controller for compensating input signals. The selection of the linear transformation having the lowest error improves the quality of the pixel response without requiring a greater amount of memory or computation in use. Although additional computation is necessary to determine the desired, optimum, linear transformation, this additional computation can be performed in a manufacturing calibration step.

The error computation may be adapted to optimize the visual quality of the display. For example, one can employ different error weightings for different brightness levels or colors. Alternatively, it may be recognized that many small errors are relatively unimportant, while a few large errors are noticeable and the weighting may be dependent on the magnitude of the error.

Referring to FIG. 5, a desired curve 200 and an actual performance curve 202 are illustrated. The desired, corrected curve 200 typically runs from 0 to 255 (for an 8-bit system, 10- or 12-bit systems may be employed and generally any number of bits may be used depending on the OLED device application) and has a linear response in some useful light output space so that increases in the driving signal, for example, code values, result in corresponding increases in light output across the entire range of code values. The linear curve 204*a* approximates the actual performance 202. The compensation curve 204*a* is formed from the measured performance at the pair of points 220*a*, 220*b*. Employing measurements at points 220*a*, 220*b*, the linear curve 204*a* defines a linear transformation having an offset value of 50 with the illustrated gain (slope of the line). The offset and gain values are intended to provide a simple means to calculate a correction to an input signal to form the desired output for each light-emitting element or group of elements. Graphically, the desired input value, e.g. code value 50, is desired to drive a luminance output, shown as 50 for simplicity. However, because the response of the light-emitter (curve 202) does not correspond to the desired response curve 200, the actual luminance output will be 20, as indicated at response value point 222*a*. Using this compensation curve, an input code value of 50 is intended to provide an output of 50 with a code value of 80. However, as can be seen from the actual performance curve 202, a code value of 80 will drive an output luminance that is about 75 (point 222*b*). This may be somewhat improved over an output of 20, but the desired output of 50 is not achieved. Hence, we can conclude that the compensation curve 204*a* is inaccurate and has an error of 25=75−50 at an input code value of 50 and a compensated code value of 80.

Mathematically, the linear transformation may be computed as shown in equation 1, where the input code value i is multiplied by the gain ratio of the desired curve 200 and the approximate representation of the performance curve 204. The offset value is calculated by subtracting the y-intercept of the approximation 204 from the y-intercept of the desired curve 200, then dividing that difference by the slope of the approximation 200.

$$\text{Output}_i=(i\times\text{GainRatio})+\text{Offset} \qquad \text{Equation 1}$$

The error between the desired curves can be written as:

$$\text{Error}_{a,b}=\sum_{i=min}^{i=max}|(M_i-P_i)| \qquad \text{Equation 2}$$

Where the input signal ranges from min to max (e.g. 0 to 255), the simplified representative values at each input signal value i is $M_i$ and the actual performance value is $P_i$ corresponding to the offset and gain values derived from the linear curve formed from code values a and b. It is also possible to combine two or more performance measurements to calculate a linear transformation.

After the error associated with the offset and gain of the first group of code values is calculated, a second group of code values is chosen and the error measurement repeated. The process continues for as many groups as is desired, and the gain and offset values having the preferred error (typically the minimum) is chosen.

Figure 8:
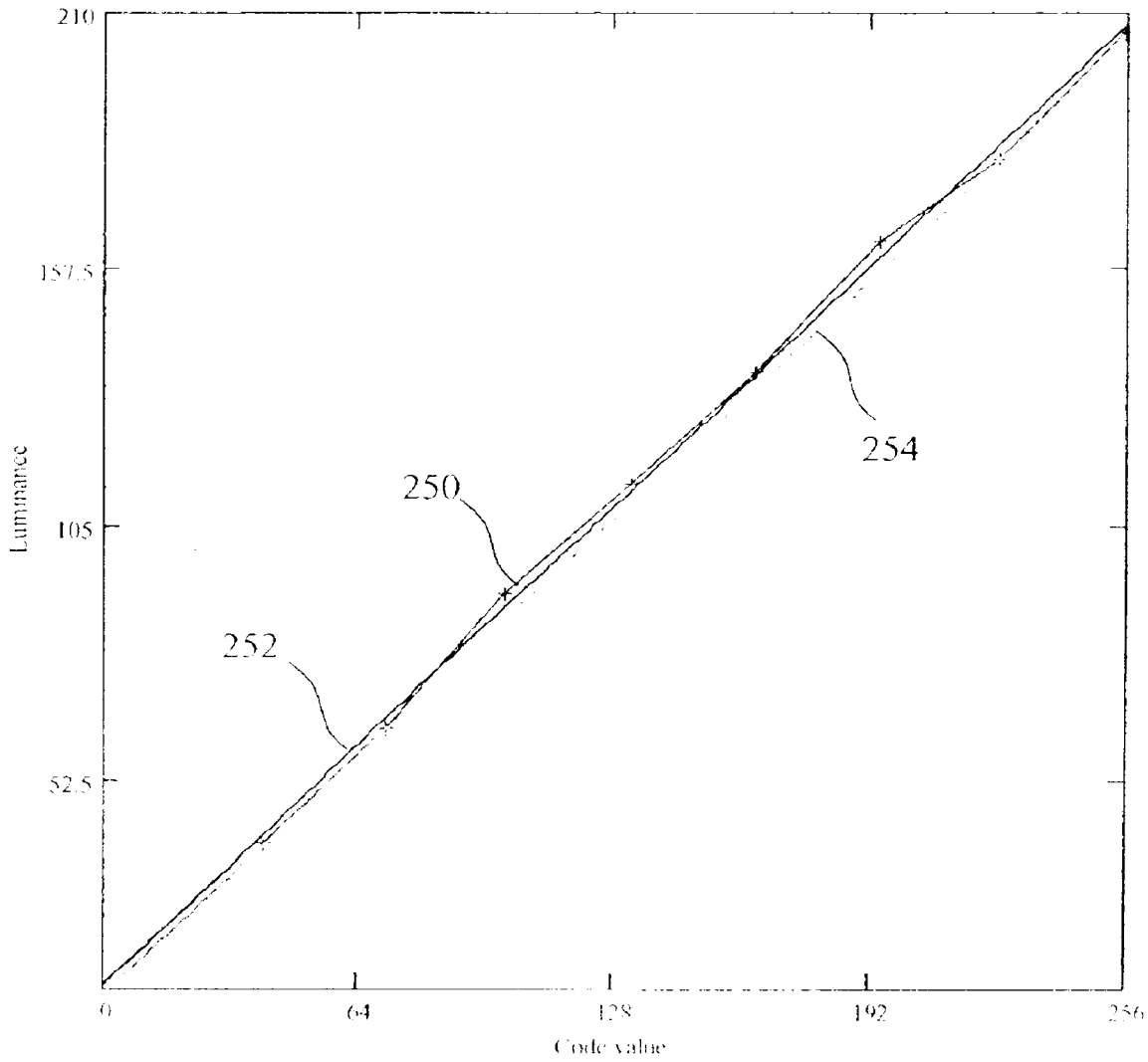
FIG. 8 is a graph illustrating the performance of an OLED device as described in the present invention.

Referring to FIG. 6, different pair of points, 220*c* and 220*d* is employed to form the compensation curve 204*b*. In this case, the offset value is approximately at input code value 5 and an input code value of 50 is linearly transformed into a code value of 60 that drives an actual performance of 50 (point 222*c*), eliminating the error at that point. Hence, compensation curve 204*b* is superior to compensation curve 204*a* and may be chosen in preference to it. In general, the actual response is compared to the approximation curve and the error at each code value for the entire range of code values employed for the display is calculated and summed, rather than at only a single point in the example shown in FIGS. 5 and 6. The error in the curve and associated linear transformation are then compared with the error of other curves to select the preferred group of points defining a compensation curve and linear transformation. The total error may be graphically shown as the area between the two curves 202 and 204*a* (shown in FIG. 5) or between the two curves 202 and 204*b* (shown in FIG. 6). Referring to FIG. 8, a graph illustrates actual performance as measured and approximated by Applicant.

A variety of methods may be employed to choose the groups. One method, for example, may be to choose one of a pair of code values from a first set of several code values below a mean code value and a second of the pair of code values from a second set of several code values above a mean code value. The central code value of the second set may be chosen together with the minimum (or maximum) code value of the first set and the total error computed. The next larger or smaller code value of the first set is then selected and the process repeated until a minimum is found. Employing the code value in the first set having the minimum error, a similar series of calculations may be performed with a series of code values from the second set. The code values having the resulting minimum found as a result of the second series may be employed as the preferred pair of code values and the corresponding offset and gain values used to perform the correction for the light-emitter or group of light emitters.

It may be true, however, that some errors at some code values are less objectionable than errors at other code values. For example, applicants have noted that errors at low code values are more noticeable than errors at relatively higher code values. Hence the error at lower code values may be weighted more strongly, for example, by multiplying them by a number greater than one, such as 1.5, before they are summed as shown in Equation 3, where $W_i$ represents the weighting value associated with each code value i.

$$\text{Error}_{a,b} = \sum_{i=min}^{i=max} W_i \times |(M_i - P_i)| \quad \text{Equation 3}$$

Likewise, a few errors having a large magnitude may be more objectionable than relatively more errors have a smaller magnitude, even though the sum of the errors may be similar. In this case, a non-linear function may be employed as a weighting factor, for example a power function, and applied to the error values at each code value before summing, as shown in Equation 4 where W(e) represents the weighting function associated difference value e.

$$\text{Error}_{a,b} = \sum_{i=min}^{i=max} W(|(M_i - P_i)|) \quad \text{Equation 4}$$

In various embodiments of the present invention, other means of measuring the error may be employed. For example, root mean square error may be employed. It is also possible to form a linear estimation and transformation based on more than two data points, for example, a least squares fit may be employed.

In one embodiment of the present invention, the same code values may be chosen for all of the light-emitting elements in a plurality of OLED devices. In practice, it is often the case that different OLED devices may have different overall characteristics. In such cases, a different set of pre-determined code values may be used to measure the performance of the different devices.

Figure 7:
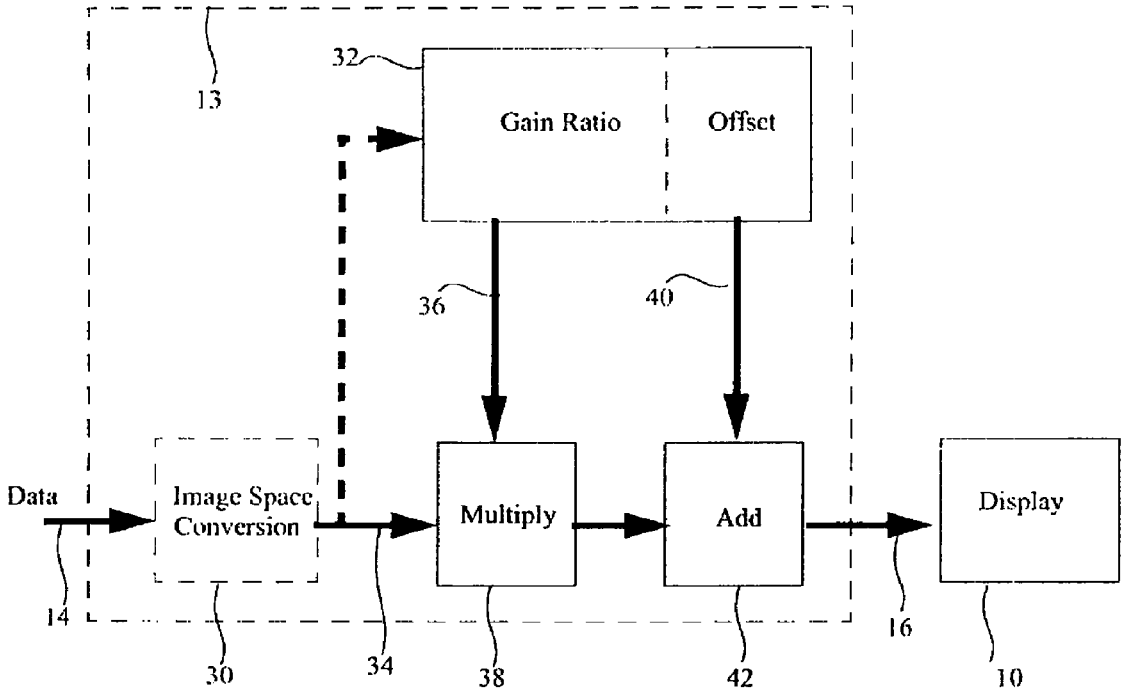
FIG. 7 is a schematic diagram according to an embodiment of the present invention.

Referring to FIG. 7, a digital linear transformation circuit is illustrated showing an input signal value 14 optionally converted into a linear image space using, for example, a lookup table 30 and applied to a lookup table 32 comprising gain ratio and offset values that are applied to the image space converted input signal 34. The converted input signal 34 is multiplied by the gain ratio value 36 with multiplier 38 and then the offset value 40 is added using adder 42 to form a compensated signal 16 that is applied to the display 10. An additional imaging space conversion may be employed (not shown) before the compensated signal 16 is applied to the display 10.

In order to minimize the number of code value groups that are analyzed to find the group having the preferred difference, it may be useful to select pairs of code values wherein at least one code value of the three or more code values is less than the average code value over the range and at least one second code value of the three or more code values is greater than the average code value over the range. Thus, code values that are well separated and are more likely to accurately represent the actual performance of the OLED device may be selected. It may also be possible to select one code value from one set of different pairs of code values and then including one of the code values of the pair having the preferred difference in a second set and finding a second preferred difference. More specifically, the first set may include one code value in one half of the range and a plurality of code values in the second half of the range and the second set may include one value in the second half of the range and a plurality of code values in the first half of the range. For example, in an eight-bit system with a median code value of 128, one code value of 192 may be paired with a series of code values from 0 to 127. The pair having the lowest error may specify the preferred code value between 0 and 127 (inclusive). That preferred code value may then be paired with a series of code values from 128 to 255. The pair having the lowest error may then be selected. In this way, all possible pair combinations might not be selected, thereby reducing the computational burden of selecting the preferred pair of code values and associated linear transformations.

The different code values may be predetermined and may be the same for each of a plurality of active-matrix OLED devices, particularly if it is known that the average performance of the plurality of OLED devices is similar. However, if the average performance of the plurality of OLED devices is different, it may be useful to use different pre-determined code values selected on the basis of the overall OLED device performance.

In various embodiments of the present invention, the OLED display may be a color display comprising light-emitting elements of multiple, different colors and wherein the white point of the display is adjusted by adjusting the linear transformation for each light-emitting element to modify the average brightness of the display for each color of light. The linear transformation for each light-emitting element may also be adjusted to modify the average brightness of the display or the linear transformation for each light-emitting element may be adjusted over time to compensate for decreasing display brightness.

According to various exemplary embodiments of the present invention, the compensation method may be applied to either active-matrix or passive-matrix OLED devices. Likewise, the metric employed to measure the performance of one or more light-emitting elements of an OLED device may be the light output of the light-emitting elements in response to input signals or the current resulting from the application of an input signal to the light-emitting elements. The performance measurements may be made, for example, by employing an optical measurement device (for example, a digital camera) for measuring the light output of the OLED device in response to the multi-valued input signal. Alternatively, an ammeter may be employed to measure the current.

In another exemplary embodiment of the present invention, an OLED device, having a plurality of light-emitting elements, includes an OLED display having one or more light-emitting elements. Each light-emitting element includes a first and second electrodes and at least one light-emitting layer formed between the electrodes responsive to a current passing through the electrodes. An electronic circuit is responsive to an external controller that causes a current to pass through the electrodes and the light-emitting layer. The external controller is configured to:

i) measure the performance of one or more of the light-emitting elements with three or more different drive signals;

ii) form at least two different groups of code values from the three or more code values and calculate a linear transformation that converts an input signal to a compensated signal from the performance measurements for each of the groups;

iii) calculate the difference between the measured performance and the compensated signal over the range of code values for each of the groups;

iv) select the linear transformation with a preferred difference; and v) receive an input signal, and employ the linear transformation to calculate a compensated signal to drive the OLED display.

In further embodiments of the present invention, the linear transformation may comprise a multiplier for multiplying the input signal by a gain value, and an adder for adding an offset value.

To reduce the storage requirements within the circuit 13, the offset and gain ratio values for each light-emitting element may be stored together at single address locations of the lookup table. Alternatively, the offset values for each light-emitting element may be stored with a first number of bits and the gain ratio values may be stored at a second number of bits, and the first and second number of bits may be different. In another embodiment, either of the offset or gain values for each light-emitting element may be stored as a difference from a mean.

In another embodiment, the present invention is employed in a flat-panel OLED device composed of small molecule or polymeric OLEDs as disclosed in but not limited to U.S. Pat. No. 4,769,292, issued Sep. 6, 1988 to Tang et al., and U.S. Pat. No. 5,061,569, issued Oct. 29, 1991 to VanSlyke et al. Many combinations and variations of organic light-emitting displays can be used to fabricate such a device, including both active- and passive-matrix OLED displays having either a top- or bottom-emitter architecture.

The invention has been described in detail with particular reference to certain embodiments thereof, but one skilled in the art will understand that variations and modifications can be effected within the spirit and scope of the invention.

PARTS LIST

10 OLED display
12 external controller
13 circuitry
14 input signal
16 compensated signal
18 OLED light-emitting element
30 image space conversion
32 memory
34 converted input signal
36 gain ratio signal
38 multiplier
40 offset signal
42 adder
100 provide OLED step
105 measure performance step
110 form code value groups step
115 calculate linear transformation step
120 calculate difference step
122 Done step
125 select preferred transformation step
130 receive input signal step
135 calculate compensation step
140 drive OLED step
150 measure performance step
155 select group step
160 form offset and gain step
165 calculate error step
200 desired response curve
202 sample real response curve
204, 204*a*, 204*b* linear function
220*a*, 220*b*, 220*c*, 220*d* measured value points
222*a*, 222*b*, 222*c*, 222*d* response value

The invention claimed is:

1. A method of compensating uniformity of an OLED display having one or more light-emitting elements, comprising the steps of:

a) providing the OLED display having the one or more light-emitting elements, each light-emitting element comprising a first electrode and a second electrode and at least one light-emitting layer formed between the electrodes responsive to a current passing through the electrodes and an electronic circuit responsive to an external controller causing a current to pass through the electrodes and the light-emitting layer to emit light;

b) measuring the performance of the one or more light-emitting elements at three or more different code values;

c) forming at least two different groups of code values from the three or more code values, calculating a linear transformation converting an input signal to a compensated signal from the performance measurements for each of the groups;

d) calculating the difference between the measured performance and compensated signal over the range of code values for each of the groups;

e) selecting the linear transformation having a preferred difference; and f) receiving an input signal and employing the selected linear transformation to calculate a compensated signal to drive the OLED display.

2. The method of claim 1, wherein at least one code value of the three or more code values is less than the average code value over the range and at least one second code value of the three or more code values is greater than the average code value over the range.

3. The method of claim 1, wherein the difference between the measured performance and the input signal is calculated by summing the difference between the measured performance and the compensated signal for each of the code values in the range, and the difference at each of the code values in the range is weighted by the visibility of the difference.

4. The method of claim 1, wherein two or more performance measurements are combined to calculate a linear transformation.

5. The method of claim 1, wherein the OLED display is a color display comprising light-emitting elements of multiple colors and a different linear transformation is determined for each color of light-emitting element.

6. The method of claim 1, wherein the OLED display is a color display comprising light-emitting elements of multiple colors and wherein the white point of the display is adjusted by adjusting the linear transformation for each light-emitting element to modify the average brightness of the display for each color of light emitted.

7. The method of claim 1, wherein the linear transformation for each light-emitting element is adjusted to modify the average brightness of the display.

8. The method of claim 1, wherein the linear transformation for each light-emitting element is adjusted over time to compensate for decreasing display brightness.

9. The method of claim 1, further comprising the steps of finding a first preferred difference using one set of different groups of code values, including the first preferred difference in a second set of different code values, and finding a second preferred difference therefrom.

10. The method of claim 9, wherein the first set includes one code value in one half of the range and a plurality of code values in the second half of the range and the second set includes one value in the second half of the range and a plurality of code values in the first half of the range.

11. An OLED display, comprising:

a) one or more OLED light-emitting elements, each light-emitting element comprising a first and a second electrode and at least one light-emitting layer formed between the first and second electrodes, responsive to a current passing through the electrodes to emit light;

b) an electronic circuit for driving current through the first and second electrodes and the light-emitting layer of each of the one or more light-emitting elements in response to a compensated signal;

c) a controller adapted to:

i) measure the performance of one or more of the light-emitting elements with three or more different drive signals;

ii) form at least two different groups of code values from the three or more code values and calculate a linear transformation that converts an input signal to a compensated signal from the performance measurements for each of the groups;

iii) calculate the difference between the measured performance and the compensated signal over the range of code values for each of the groups;

iv) select the linear transformation with a preferred difference;

v) receive an input signal, and employ the linear transformation to calculate a compensated signal; and vi) provide the compensated signal to the electronic circuit to cause it to drive the one or more light-emitting elements.

12. The OLED device of claim 11, further comprising a multiplier for multiplying the input signal by a gain value and an adder for adding an offset value.

13. The OLED display of claim 12, further comprising a lookup table for storing, together at single address locations, the offset and gain values for each light-emitting element.

14. The OLED display of claim 13, wherein either of the offset or gain values for each light-emitting element is stored in the lookup table as a difference from a mean.

15. The OLED display of claim 11, wherein the performance measurements are measurements of light output or current.

* * * * *